United States Patent [19]

Maury

[11] 4,069,762

[45] Jan. 24, 1978

[54] EMISSIVE DECOYS

[75] Inventor: Louis Maury, Toulouse, France

[73] Assignee: Societe E. Lacroix, Muret, France

[21] Appl. No.: 652,348

[22] Filed: Jan. 26, 1976

[30] Foreign Application Priority Data

Jan. 29, 1975 France ..... 75 02725

[51] Int. Cl.[2] ..... F42B 4/26

[52] U.S. Cl. ..... 102/90; 102/37.8

[58] Field of Search ..... 102/6, 37.6, 37.8, 65, 102/66, 90

[56] References Cited

U.S. PATENT DOCUMENTS

| | | | |
|---|---|---|---|
| 1,819,106 | 8/1931 | McBride et al. | 102/66 |
| 2,119,697 | 6/1938 | Anderson | 102/37.8 |
| 3,427,973 | 2/1969 | Beers | 102/65 |
| 3,762,327 | 10/1973 | Murray et al. | 102/37.6 |
| 3,841,219 | 10/1974 | Schillreff | 102/37.6 |

FOREIGN PATENT DOCUMENTS

| | | | |
|---|---|---|---|
| 712,385 | 6/1965 | Canada | 102/66 |

*Primary Examiner*—Verlin R. Pendegrass
*Attorney, Agent, or Firm*—Pollock, Vande Sande & Priddy

[57] ABSTRACT

An elementary emissive decoy for protecting, say, a ship from an infra-red guided missile has a water-tight case provided with floats and in which there is a liquid aerosol, a high calorific pyrotechnic composition core and an ignition device for the core. A plurality of decoys are launched from the ship one after another to create an artificial moving target.

6 Claims, 3 Drawing Figures

EMISSIVE DECOYS

The present invention relates to protection means able to be used in an attempt to protect a vehicle, such as a surface ship from the threat constituted by a missile or similar self-propelled offensive device, provided with an infra-red guidance system.

For the purpose of protecting a vehicle from an infra-red guided missile, the prior art already proposes placing at a certain point in space, one or more possible movable decoys, having infra-red radiation and able to be substituted for the vehicle in the guidance system of the missile.

Protection means of this type remain effective in the case where the vehicle to be protected is an aircraft. In fact, the source of infra-red radiation of the aircraft is constituted essentially by the hot part of its propulsion means. The high temperature prevailing in this part establishes for the target constituted by this aircraft, an infra-red source whose brightness spectrum comprises a dominant factor in the near infra-red (wave length of the order of $4\mu$). Furthermore, the dimensions of the source remain relatively small. Due to this, it is easy to re-constitute an artificial target representing a brightness spectrum very close to that of the actual target constituted by the aircraft, by means of an appropriate pyrotechnic composition. In addition, the considerable speed of the aircraft enables it to move away rapidly from the positioned decoy or decoys in order that the explosion of the missile in the vicinity of the latter no longer constitutes any danger.

On the other hand, in the case where the vehicle to be protected is a surface ship, the above-described solution remains only slightly effective. In fact, the ship constitutes a target of considerable size, the temperature of which remains relatively low, approximately 15° C greater than the temperature of the bottom of the sea. The result of this low temperature gradient is that the brightness spectrum of the ship has a dominant factor in the far infra-red (wave length of the order of $10\mu$) in a characteristic manner. It is therefore obvious that the detection and guidance systems of the missiles must be calculated to react essentially to radiation having a spectrum similar to that of a ship.

The decoys already employed using infra-red radiation are for the most part based on a predetermined pyrotechnic composition. The high combustion temperature of these compositions and the relatively small dimensions of the source of radiation which they form result in a radiation spectrum whose dominant factor is in the near infra-red. The proportion of far infra-red in this radiation is very slight, approximately one tenth that of the near infra-red. Since, in addition, the dimensions of the infra-red source constituted by the decoy or decoys remains limited, it will be understood that the chances of deceiving the missile guidance system with decoys of this type are slight.

The main object of the present invention is to provide an emissive decoy able to constitute an artificial target of considerable dimensions, whose brightness spectrum is close to that of the ship to deceive the infra-red guidance system of the missile.

According to a first aspect of the present invention there is provided an elementary emissive decoy intended to be set in operation in an attempt to protect a vehicle such as a surface ship from the threat constituted by an infra-red guided missile, comprising in a water-tight case provided with floats, a liquid aerosol, a core of a pyrotechnic composition having a high calorific effect and a device for controlling the ignition of the core.

As known per se, the sudden dispersion into damp air of the liquid aerosol contained in the casing causes the production of a cloud of considerable dimensions of very fine droplets. By causing this dispersion by means of a core of a pyrotechnic composition able to give the liquid aerosol considerable calorific energy before dispersion, the applicants have ascertained that the cloud of droplets thus created had a brightness spectrum very close to that of a surface ship, in the sense that it had a dominant factor in the far infra-red (wave length of between 8 and $14\mu$). The "dilution" of the calorific energy provided by the pyrotechnic core in a cloud of fine droplets of considerable volume makes it possible to produce an artificial target able to be substituted for the ship in the missile guidance system, both as regards its dimensions and its brightness spectrum.

The duration of the above-mentioned elementary decoy is brief (of the order of several seconds).

This is why the invention also relates to a method of using such decoys, making it possible to obtain an artificial target of substantially constant brightness, able to attract the guidance system of the missile for a relatively long period of time, in order to enable the ship to escape.

According to a second aspect of the present invention there is provided a method for attempting to protect a vehicle, such as a surface ship, from a threat constituted by an infra-red guided missile, which consists in spreading in a chosen region of space a plurality of elementary emissive decoys according to claim 1, and of setting the decoys in operation one after the other in order to create an artificial moving target of substantially constant brightness for the missile.

Preferably, the elementary decoys are spread by means of a launching device such as a rocket, about which they are initially arranged in successive stages, in order to be ejected radially therefrom. The launching device is preferably designed to rotate about its own axis in order that the elementary decoys may be ejected one after the other in a substantially parallel direction.

First, the decoys will be located virtually in a straight line on the surface of the water. It will also be an advantage if the directions of ejection of the decoys are vertical and directed downwards, such that the trajectory of the launching device is not modified, except in its bearing, by the ejection of the various decoys.

Putting the decoys into operation successively makes it possible to create for the missile the illusion of a moving target which has a substantially constant brightness and which also seems to move in a certain direction. Such a "movement" of the artificial target makes it possible to divert the missile, the "movement" of the target naturally taking place in a general direction remote from the trajectory of the ship. With the progressive increase in the distance between the ship and moving target, it is clear that, in combination with an appropriate manoeuver, the ship may escape the field of detection of the missile. It may be advantageous to place a smoke screen between the ship and this missile, in order to block out the image of the ship to the benefit of the artificial target.

The present invention will now be described, with reference to the accompanying drawings in which.

Figure 1:
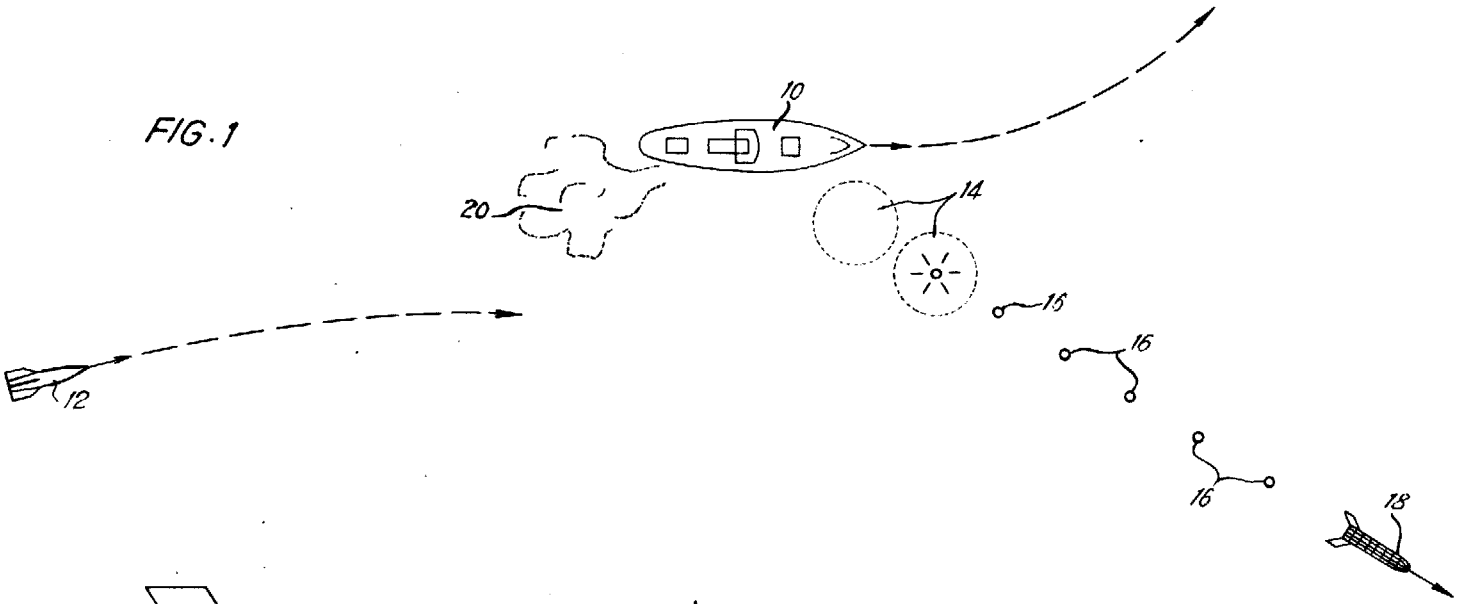
FIG. 1 is a diagrammatic view illustrating a method of using a plurality of emissive decoys according to the present invention.

In FIG. 1, the reference numeral 10 designates a surface ship which is to be protected from an infra-red guided missile or similar self-propelled offensive device 12, launched at the ship.

The principle used consists of substituting for the ship 10, a succession of artificial targets such as 14, each able to attract the guidance system of the missile 12 by forming for the latter an image similar to that of the ship. The succession of targets 14 is produced by setting off one after the other a plurality of floating elementary decoys 16, after having spread these decoys in a given direction by means of an appropriate launching device of the rocket type 18. Preferably, the elementary decoys 16 are launched from the rocket 18 in order to float on the surface of the water in a straight line of predetermined direction. In most cases, this direction is different from the direction of travel of the ship, the latter thus having the possibility of manoeuvering in order to increase still further the space between the succession of targets 14 and itself.

The rocket 18 is designed to launch 150 elementary decoys 16. The launching of the first decoy can take place with a delay, of between 0.3 seconds and 10 seconds for example, from the departure of the rocket 18 from the ship 10.

As will be seen hereafter, the effective duration of each artificial target is limited to several seconds. The delay introduced between the operation of successive decoys 16 is calculated so that the brightness of the overall artificial target, constituted by the target or targets 14 which are still effective, approximates to a given value corresponding to the brightness of the ship 10 as seen from the missile 12. Therefore the overall duration of the artificial target may be 10 minutes or even more. At the same time as firing the rocket 18, it may be advantageous to place a smoke screen 20 between the ship 10 and the missile 12 in order to temporarily blind the latter and divert it more easily towards the first target 14 created close to the ship.

Figure 2:
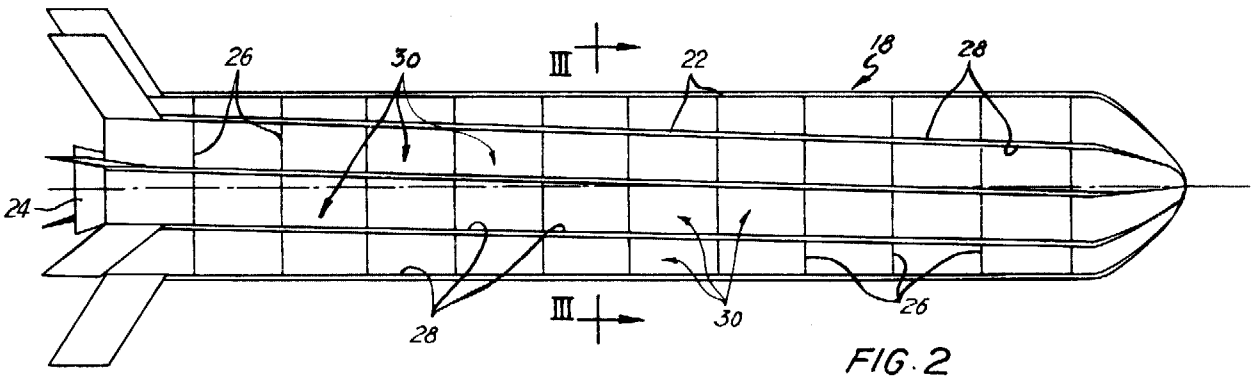
FIG. 2 shows a launching device for the decoys, which can be used in the method of the invention.

FIG. 2 shows a possible construction of the launching rocket 18. This rocket is of the type described and claimed in French Patent Number 75.02541 filed on Jan. 28, 1974 in the name of the Applicant for a "Rocket for launching decoys ." References may be made to this patent for the description and operation of this rocket 18.

Very briefly, the rocket 18 comprises a plurality of radial fins 22 which wind slightly helically around a tubular support structure (not shown), and is equipped with a powder propellant 24. A plurality of transverse partitions 26 define, with the fins 22, a plurality of identical cells 28 of prismatic shape each having a cross-section in the form of a circular sector and able to receive an elementary emissive decoy 30.

The launching rocket 18 is also provided with a time control device able to trigger the ejection of the various elementary decoys 30 according to a predetermined schedule.

According to a preferred embodiment, described in the aforesaid patent, the ejection of successive decoys is controlled in order to take place in substantially the same direction and more precisely in a vertical downwards direction. Thus, the rocket 18 is gradually lightened, but its trajectory remains unchanged. In order to control these ejections in rapid succession, in a substantially constant direction, it is possible to use pyrotechnic delays between the successive ejection charges, the durection of which delays corresponds to a complete revolution of the rocket 18 about itself.

In an equally advantageous variation, ejection of the decoys takes place simultaneously stage by stage such that the quantity of overall movement resulting from these ejections is zero and the trajectory of the rocket 18 therefore remains unchanged. In this variation, the elementary decoys will be distributed on the surface of the water substantially along a sinusoid.

In both of the above-described methods, it is desirable that the decoys located in the rear part of the rocket 18 be ejected first, in order for the rocket retain good stability.

Figure 3:
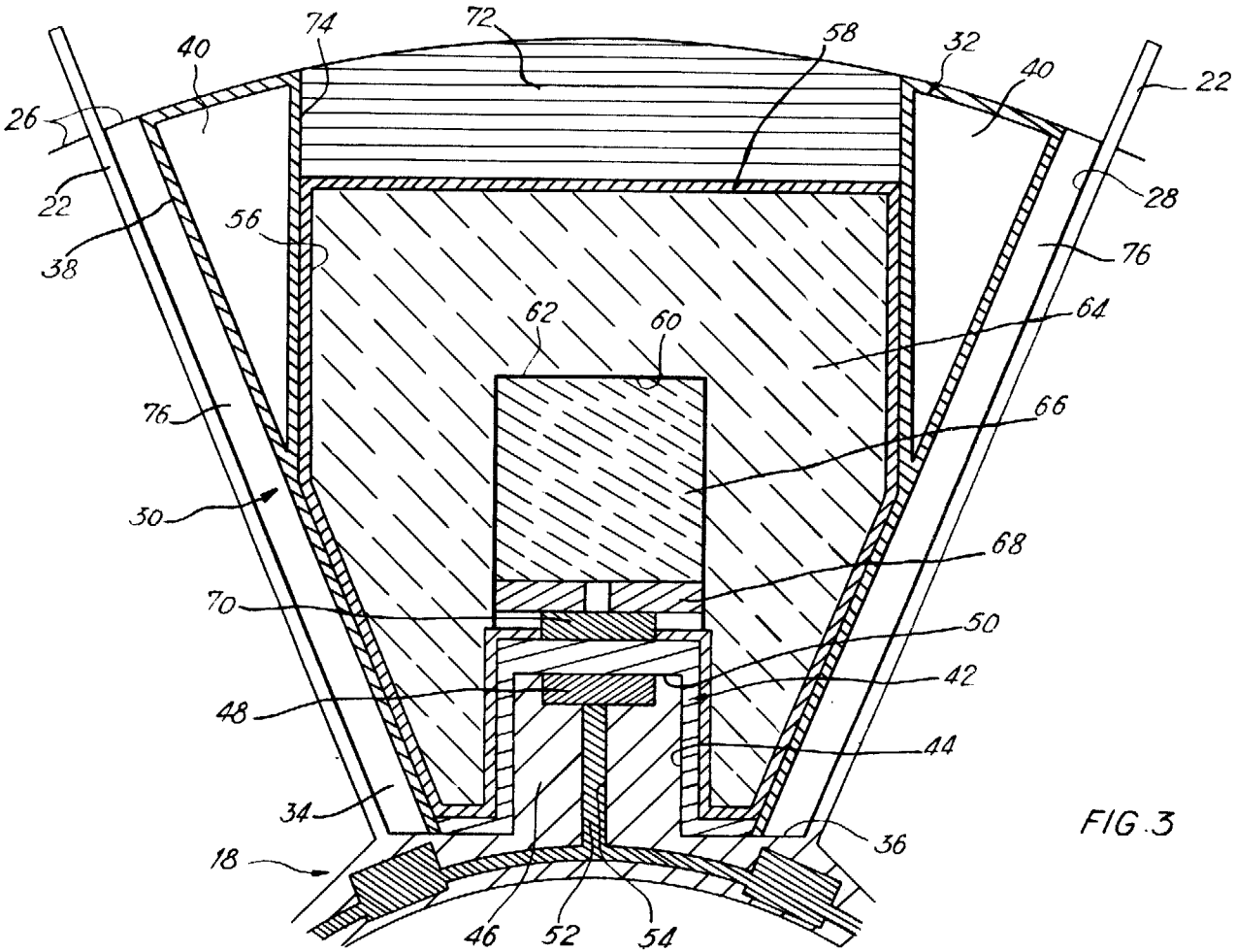
FIG. 3 is a sectional view, to an enlarged scale, on line III—III of FIG. 2, showing an elementary emissive decoy according to the invention.

FIG. 3 is a sectional view of an elementary emissive projectile according to the invention, in the case where one uses a launching rocket 18 such as that illustrated in FIG. 2 and which is described in the aforesaid French, patent.

The decoy 30 illustrated in FIG. 3 is composed of a casing 32 of plastics material, and of general prismatic shape and having a cross-section in the form of a sector of an annulus. The narrower lower part 34 of the casing 32 is intended to be received in the base 36 of the cell 28 formed between two successive radical fins by two adjacent transverse partitions 26 interconnecting these fins.

The wider upper part 38 of the casing 32 encloses two water-tight compartments 40 forming floats which enable the casing 32 to float in a satisfactory manner. The normal position of the casing on the water is that shown in FIG. 3: the lower part 34 is immersed and the upper part 38 is located at least partly above the surface of the water.

As described in the aforesaid patent, part 34 of the casing is provided with a pressure cap 42 appropriately fixed to the casing 32. This cap defines an inner cylindrical recess 44 in which is fitted a radial tubular support member 46 integral with the support structure for the device 18. A pyrotechnic charge 48 is placed between the member 46 and the base 50 of the recess 44 with a view to the ejection of the elementary decoy 30 in a radial direction perpendicular to the axis of the device 18, by virtue of the guidance of the cap 42 on the member 46.

Ignition of the charge 48 is assured by a pyrotechnic band 52 located in the central passage 54 provided in the support member 46. However, it will be understood that the passage 54 could be reserved for an electrical ignition connection or any similar means.

The casing 32 comprises mainly a first compartment 56 closed in a water-tight manner by means of a cover 58 of appropriate shape and a second compartment 60 formed inside the first by a water-tight cover 62 appropriately fixed by welding for example to the cover 58. According to the invention, the compartment 56 is filled with a liquid aerosol such as titanium tetrachloride or tin tetrachloride and the compartment 60 is filled with a pyrotechnic composition 66 having a high calorific effect. For example, this composition 66 can be constituted by a mixture of aluminum (or boron) and potassium perchlorate in appropriate proportions. Ignition of the composition 66 is assured through a perforated disc 68, by a pyrotechnic primer 70 also housed in the cover 62.

Ignition of the primer 70 may be achieved either by a pair of pyrotechnic bands having a delay, initiated by the ejection charge 48, or preferably by an electronic ignition circuit 72 having a delay, housed in a compartment 74 formed in the upper part 38 of the case 32.

The compartment 56 advantageously comprises a certain number of partitions (not shown) intended to oppose both deformation of the cover 58 and displacement in the latter of the liquid aerosol 64.

The convergent walls 76 of the casing have a corrugated shape in order to have sufficient rigidity in the direction of ejection of the casing 32. This corrugated shape of the walls 76 also makes it possible to quickly absorb the kinetic energy of the casing 32 when the latter comes into contact with the water.

In order to facilitate the transfer of energy from the pyrotechnic composition 66 to the aerosol 64, the structure and/or material of the cover 60 or more precisely of the part of this cover which separates the compartments 60 and 56 will be such that this part of the cover breaks instantaneously at the time of ignition of the composition 66. On the contrary, the structure of the outer cover 58 and/or the material constituting the latter will be such that this case may undergo a considerable elongation before bursting at the time of ignition.

The elementary emissive decoy 30 is set in operation in the following manner:

At the time *t1* after the departure of the rocket 18 from the ship 10, the charge 48 is ignited. As abovementioned, this ignition may advantageously take place when the cell 28 containing the decoy is directed downwards in a substantially vertical direction. The hot gases resulting from the combustion of the charge 48 press against the member 46 in order to expel from the latter the cap 42 which forms the base of the casing 32. Simultaneously, the electronic circuit 72 is triggered, for example by disconnection of an electrical connection connecting this circuit by means of a removable connection (not shown) to a continuous electrical supply provided on the device 18.

The ejected decoy falls into the water and is stabilized by the floats 40 and undulations of the walls 76.

At a time *t2* fixed by the time constant (possibly adjustable) of the circuit 72, the primer 70 is ignited and ignites the composition 66. As it burns, the latter causes considerable heating of the aerosol 54, then its dispersion into space.

In contact with the damp air, the aerosol hydrolyses according to the reaction:

$$TiCl_4 + 4H_2O = 4HCl + Ti(OH)_4.$$

This reaction causes the production of a large cloud of fine droplets. The initial heating of the aerosol and the "dilution" of this heating in the cloud thus produced creates an infra-red source whose radiation spectrum is very close to that of a ship, in the sense that is has a dominant factor in the far infra-red (wave length of between 8 and 14$\mu$). The duration of this source is very limited, of the order of several seconds.

It will be understood that the elementary decoy described with reference to FIG. 3 constitutes the basic member which is used for carrying out the method described above with reference to FIG. 1.

It will also be understood that the general shape of the casing 32 is dictated by the shape of the cells 28 provided on the launching rocket: the latter can be of any appropriate known type. The use of the rocket described in French Patent No. 75.02541 is given as a preferred example, to give the maximum occupation of the useful volume achieved by the cellular structure of this rocket.

Numerous modifications may be applied to the elementary decoy described above: in particular, it is possible to replace the electronic circuit 72 by any other appropriate known delay means. The composition 66, the shape of the casing 32, the arrangement of the floats 40, the method of ejection of the decoys 30, etc. can all be modified.

What is claimed is:

1. An elementary emissive decoy intended to be set in operation in an attempt to protect a vehicle such as a surface ship from the threat constituted by an infra-red guided missile, comprising a water-tight casing provided with float means, including a first compartment and a second compartment a portion of which extends within the said first compartment, a liquid aerosol enclosed within the said first compartment, a pyrotechnic composition having a high calorific effect enclosed within the said second compartment, and means for controlling the ignition of the pyrotechnic composition, whereby ignition of the pyrotechnic composition forms a cloud of droplets of the aerosol while giving it considerable calorific energy before dispersion.

2. An elementary emissive decoy according to claim 1, wherein the said first and second compartments have substantially parallel covers adapted to be forced open to permit dispersion of the aerosol, the cover of the said second compartment being of less strength than the cover of the said first compartment.

3. An elementary emissive decoy according to claim 1 in which the device for controlling the ignition comprises an electronic circuit having a delay.

4. An elementary emissive decoy according to claim 1, in which the casing has an outer surface which is able to retard the motion of the casing it comes into contact with the water.

5. An elementary emissive decoy according to claim 1, in which is compartmentalised and in which the compartment that receives the liquid aerosol is provided with partitions.

6. An elementary emissive decoy according to claim 1, in which the liquid aerosol is titanium tetrachloride.

* * * * *